US006653570B1

(12) United States Patent
Elrod

(10) Patent No.: US 6,653,570 B1
(45) Date of Patent: Nov. 25, 2003

(54) RIBBON CABLE

(76) Inventor: David L. Elrod, 716 Fairforest Dr., Greenwood, SC (US) 29646

( * ) Notice: Subject to any disclaimer, the term of this patent is extended or adjusted under 35 U.S.C. 154(b) by 52 days.

(21) Appl. No.: 10/000,876

(22) Filed: Nov. 28, 2001

Related U.S. Application Data

(60) Provisional application No. 60/283,042, filed on Apr. 11, 2001.

(51) Int. Cl.[7] ..... H01B 7/08
(52) U.S. Cl. ..... 174/117 FF
(58) Field of Search ..... 174/36, 117 F, 174/117 FF

(56) References Cited

U.S. PATENT DOCUMENTS

| | | | | |
|---|---|---|---|---|
| 479,525 A | * | 7/1892 | Perrine | 174/27 |
| 531,614 A | | 12/1894 | Guilleaume | |
| 2,060,913 A | | 11/1936 | Weaver | |
| 2,200,776 A | | 5/1940 | Hoover | |
| 2,586,345 A | | 2/1952 | King | |
| 3,317,657 A | | 5/1967 | Eisler | |
| 3,586,757 A | | 6/1971 | Haldeman, Jr. | |
| 5,250,755 A | * | 10/1993 | Dinzen et al. | 174/102 SC |
| 5,500,489 A | | 3/1996 | Shah et al. | |
| 5,872,334 A | | 2/1999 | Trazyik | |
| 5,900,589 A | | 5/1999 | Brunt | |
| 5,956,445 A | * | 9/1999 | Deitz et al. | 174/24 |
| 6,225,563 B1 | * | 5/2001 | Poulsen | 174/117 FF |

* cited by examiner

*Primary Examiner*—Chau N. Nguyen
(74) *Attorney, Agent, or Firm*—Dority & Manning, P.A.

(57) ABSTRACT

A ribbon conductor assembly and an electrical cable including at least one such ribbon conductor assembly. The ribbon conductor assembly includes a ribbon conductor, a dielectric jacket enclosing the ribbon conductor, and an electrically-conductive shield adjacent the jacket. In a preferred embodiment, the width of the ribbon conductor is at least approximately ten times its thickness. A two-conductor electrical cable has two ribbon conductor assemblies positioned adjacent to each other and enclosed by an electrically-insulating casing. A three-conductor electrical cable has three ribbon cable assemblies, one of which may serve as a ground conductor. The ends of the electrical cable may be connected to any suitable terminators.

16 Claims, 3 Drawing Sheets

RIBBON CABLE

This application claims the benefit of provisional Application Serial No. 60/283,042 filed Apr. 11, 2001.

BACKGROUND OF THE INVENTION

1. Field of the Invention

The present invention relates to a cable for the transmission of electrical signals. In particular, the present invention relates to an electrical cable having one or more ribbon conductor assemblies for improved signal transmission properties.

2. Discussion of Background

Electrical cables and interconnects are important but frequently overlooked components of audio and video playback systems. Well-chosen cables and interconnects can help users get the best performance from their systems, whereas poor or incompatible cables result in poor performance. The terms "cable" and "electrical cable" are often used to refer to any wiring in an audio or video system, most commonly to a power cord that connects a component to a source of electrical power such as a wall outlet, or a conductor that carries a high-current signal from a power amplifier to a loudspeaker. The term "interconnect" refers to a conductor that connects line-level signals in an audio or video system. For example, interconnects are used between source components (CD player, turntable, tape deck tuner) and the preamplifier, and between the preamplifier and the power amplifier of a typical audio system. For purposes of this specification, the terms "cable," "electrical cable" and "interconnect" are used interchangeably.

Ideal cables are "neutral," that is, they transmit electrical signals essentially instantaneously and without imposing significant distortion or degradation on the signals. However, real-world cables have electrical resistance, capacitance, and self-inductance properties which color the signals transmitted through the cables. Therefore, discriminating consumers select cables for their compatibility with the other system components, and (in some cases) for their ability to enhance the overall sound or video output of the system. Similar considerations apply to cables used in high-end computer systems, servers, and other applications where distortion-free signal transmission is a priority.

Many different types of electrical cables are available. Cables are frequently shielded to minimize the effects of electromagnetic interference on the signal-carrying conductors. Typically, shields of metal foil or braided strands of electrically-conducting material enclose the signal-carrying conductors and are electrically connected to ground potential at one or both ends of the cable. As noted above, all cables exhibit some signal degradation due to the effects of resistance/impedance, capacitance, and inductance. The most important sources of signal degradation arise from the interaction between the individual strands of multi-stranded conductors and a phenomenon known as the "skin effect." A well-known problem with multi-stranded cable is the tendency for the signal to jump from strand to strand if the cable is twisted. Each strand interface acts like a small electrical circuit that adds capacitance to the cable, resulting in degradation of the signal. In addition, the flow of electrical current sets up a magnetic field in each conductor which induces a signal in adjacent conductors and further degrades the signal.

The skin effect is a factor at audio and higher frequencies: because the self-inductance of an electrical conductor is greatest at the center of the conductor, higher-frequency signals encounter a lower-impedance path towards the outside of the conductor, which reduces the effective cross-sectional area of the conductor at those frequencies, which in turn increases the impedance of the conductor at those frequencies. Because higher-frequency signals encounter higher impedances than lower-frequency signals, the relative amplitudes of different-frequency signals are distorted during transmission. This problem is particularly evident for mixed-frequency signals: the greater the bandwidth of the signal, the greater the distortion.

Cable designers seek to minimize these effects and (particularly for cables used to transmit audio and video signals) optimize the effective bandwidth of their cables using a variety of techniques. For example, ribbon-type conductors are used in many applications. Brunt (U.S. Pat. No. 5,900,589) shows an audio transmission cable with a signal-carrying conductor of pure (or nearly pure) silver ribbon enclosed by an insulating material, where the width of the conductor is at least five times its thickness. A ground conductor lies alongside the ribbon conductor, placed so that the cross-sectional width of each the two conductors lies facing the other. The resulting assembly is enclosed by a second insulating layer, a conductive shield, and an outer insulating material.

Shah, et al. (U.S. Pat. No. 5,500,489) provide a thin, flexible cable for electronic retailing applications. Their cable includes three ribbon conductors on one side of a dielectric ribbon, and a flame-resistant, electrically-insulating jacket enclosing the ribbon with the conductors.

Haldeman, Jr. (U.S. Pat. No. 3,586,757) discloses a flexible stripline transmission line having individual conducting and insulating portions which are free to move relative to each other. The stripline consists of a pair of ribbon conductors sandwiched between three insulators, with a flexible outer cover that holds them in place. There appears to be a small air space on each side of the conductor/insulator stack.

Eisler (U.S. Pat. No. 3,317,657) shows several designs for flat electric cables for heating applications. The cables include flat conductor strands, each enveloped in a sheath of insulating film. A plurality of such sheaths are secured to a wider insulating film by an adhesive or by welding.

Hoover's flat cable (U.S. Pat. No. 2,200,776) has three pairs of insulated copper ribbons that serve as power conductors, and two additional insulated conductors for connection to motor control devices. The ribbon conductors are enclosed by fiber insulation and linen tape; the cable structure is enclosed by a copper tube.

Weaver (U.S. Pat. No. 2,060,913) and Guilleaume (U.S. Pat. No. 531,614) provide telephone cables. Weavers self-coiling cable includes one or more strands of an elastic material such as phosphor bronze alloy which can be wound in a resilient helix. The conductors are insulated and bound together by braided textile covers or otherwise. Guilleaume's telephone cable has several strands of ribbon conductors twisted together and sheathed with paper or other insulator, followed by an outer sheath of lead. The ribbon conductors in each strand are insulated from each other by paper.

Trazyik (U.S. Pat. No. 5,872,334) and King (U.S. Pat. No. 2,586,345) use conductive shields in their devices. The Trazyik high-speed cable includes a pair of cables, each having a copper wire core surrounded by a dielectric layer (such as PTFE), a ground conductor, and a conductive shield. The cables are encased in a polymeric jacket, which is impregnated with a conductive material such as carbon. King discloses a three-core paper insulated mine shaft cable.

The cable has three sets of conductors, each set consisting of a plurality of metal strands surrounded by paper insulation impregnated with micro-crystalline petroleum wax and cable-impregnating mineral oil. The conductor sets are encased in (in sequence) a metallized paper screen, a lead sheath, a layer of jute, steel wire armouring, and another layer of jute.

Despite the many types of cables available to consumers, there is a need for a wide-bandwidth, low-distortion electrical cable that can be used as a power cable or interconnect cable in a variety of different applications (audio and video systems, home theater systems, computer systems, servers, etc.). Such a cable would have a low overall impedance combined with low self-inductance, and, optionally, a dedicated ground conductor.

SUMMARY OF THE INVENTION

According to its major aspects and broadly stated, the present invention includes a ribbon conductor assembly having a ribbon conductor with an approximately rectangular cross-section transverse to a longitudinal axis of the cable, a dielectric jacket enclosing the ribbon conductor, and an electrically-conductive shield. A single-conductor electrical cable (also termed herein a "ribbon cable") includes one such ribbon conductor assembly; a multi-conductor electrical cable includes two or more such ribbon conductor assemblies positioned so that the dielectric jacket of each ribbon conductor assembly contacts the dielectric jacket of at least one other ribbon conductor assembly, with all the ribbon conductor assemblies preferably enclosed by a single electrically-insulating casing. The ends of the electrical cable may be connected to any suitable male or female connectors or terminators, including single-ended interconnects such as RCA plugs, balanced interconnects such as 3-pin XLR connectors, IEC connectors, banana plugs, two-prong and three-prong plugs or jacks, and so forth.

The ribbon conductor is an important feature of the present invention which results in surprising performance advantages over standard solid core or stranded conductor configurations (including those with circular (or approximately so) cross-sections). The ribbon conductor is made of a low-resistance material, preferably copper, silver, aluminum, conductive carbon, electrically-conductive composite materials, or mixtures or alloys thereof. While these materials are generally preferred, other electrically-conductive materials may also be useful for some applications. As used herein, the term "ribbon conductor" refers to a conductor whose transverse cross-section has a greater width than its thickness, that is, the cross-sectional width of the conductor is greater than its cross-sectional thickness. This ribbon configuration results in a lower self-inductance which enhances current flow through the conductor, resulting in lower signal distortion and concomitantly enhanced sound and video quality. The ends of connectors attached to the ribbon conductor may be plated with a selected metal or alloy (different from the metal of the connectors themselves) to further optimize current flow and/or adjust the quality of electrical signals transmitted through the conductor.

The dielectric jacket is another feature of the present invention. The jacket clamps the ribbon conductor to hold it firmly in place with air gaps on either side. Clamping the edges of the ribbon conductor provides effective damping effects without over-damping: damping controls resonance by reducing mechanical vibrations and thereby improves the frequency response of the cable. This effect is especially evident at lower frequencies, thus, the electrical cable has an improved bass response when used to transmit audio-frequency signals.

For good signal transmission through a conductor, it has now been determined that the best dielectric is no dielectric at all. That is, the optimal environment for current flow through a conductor is present when the conductor is surrounded by air (or vacuum). The dielectric jacket of the present invention secures the ribbon conductor and also forms air gaps on both sides of the conductor, ensuring that the conductor is substantially surrounded by air for the best possible signal transmission properties.

The shield is still another feature of the present invention. The shield is adjacent to the dielectric jacket of the ribbon conductor assembly, and may be applied by spraying the inner or outer surface of the jacket with metallic paint containing particles of copper, silver, gold, aluminum, carbon, graphite, or other electrically-conducting materials, or alloys or mixtures thereof, in a suitable carrier. Alternatively, the shield may be applied by coextruding a suitable electrically-conducting material with the jacket material, depositing a layer of electrically-conductive material on the jacket, or installing a foil or braided wrapping adjacent to the jacket. In a multi-conductor electrical cable constructed according to the invention, electrical contact between the shields of the individual ribbon cable assemblies optimizes the overall impedance and improves the signal-transmission properties of the cable.

The interaction of the shield with the ribbon conductor to improve signal transmission is another feature of the present invention. Current flowing in the shield produces an electron density containment field ("EDCF") that is believed to "squeeze" and contain the field produced by current flowing in the ribbon conductor. This effect is especially evident when the shield is adjacent the inner surface of the jacket, where the EDCF appears to densify the field produced by current flow in the ribbon conductor, thereby improving audio signal transmission.

The versatility of the electrical cable is yet another feature of the present invention. An electrical cable according to the invention can have one, two, or more ribbon conductor assemblies as described above, each ribbon conductor assembly with dimensions that depend on the particular application. For example, a three-conductor electrical cable may have three ribbon cable assemblies, one of which may serve as a ground conductor. The cable ends can be fitted with a variety of connectors or terminators, whether known in the art or to be developed, and the materials for the various components of the cable can be selected to optimize its electrical signal transmission properties for a particular application.

Other features and advantages of the present invention will be apparent to those skilled in the art from a careful reading of the Detailed Description of Preferred Embodiments presented below and accompanied by the drawings.

DETAILED DESCRIPTION OF PREFERRED EMBODIMENTS

Figure 1:
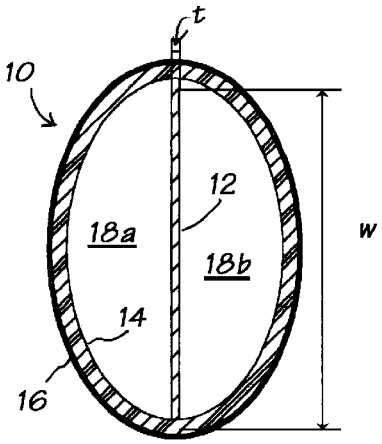
FIG. 1 is a cross-sectional view of a ribbon conductor assembly according to a preferred embodiment of the present invention.

In the following detailed description of the invention, reference numerals are used to identify structural elements, portions of elements, surfaces or areas in the drawings, as such elements, portions, surfaces or areas may be further described or explained by the entire written specification. For consistency, whenever the same numeral is used in different drawings, it indicates the same element, portion, surface or area as when first used. Unless otherwise indicated, the drawings are intended to be read together with the specification, and are to be considered a portion of the entire written description of this invention as required by 35 U.S.C. § 112. As used herein, the terms "horizontal," "vertical," "left," right," "up," "down," as well as adjectival and adverbial derivatives thereof, refer to the relative orientation of the illustrated structure as the particular drawing figure faces the reader.

Referring now to FIG. 1, there is shown a cross-sectional view of a ribbon conductor assembly 10 according to a preferred embodiment of the present invention. Ribbon conductor assembly 10 includes a conductor 12, a dielectric jacket 14, and a thin electrically-conductive shield 16 exterior to and adjacent jacket 14 so that the shield engages most of the exterior surface of the jacket, preferably substantially all of the exterior surface. Conductor 12 is of the type known as a "ribbon conductor," with an approximately rectangular cross-section transverse to its longitudinal axis (i.e., transverse to a longitudinal axis of ribbon conductor assembly 10), and a width w that is greater than a thickness t.

Jacket 14 is made of a flexible dielectric material, including but not limited to materials such as plastic, rubber, vinyl, glass or carbon fiber, polytetrafluoroethylene (PTFE), expanded polytetrafluoroethylene (ePTFE), polycarbonate, polypropylene, polyvinyl chloride (PVC), or other polymers. In a preferred embodiment of the invention, jacket 14 is made of tubing having an inner diameter slightly smaller than the width w of conductor 12. To install conductor 12 in jacket 14, the jacket 14 is compressed and the conductor is inserted therein. Once released, jacket 14 snaps back to clamp conductor 12 and hold it firmly in position with air spaces 18*a*, 18*b* on either side of the conductor.

If desired, jacket 14 may be impregnated with particles of an electrically-conductive material (metal, carbon, graphite, etc.). Depending on the materials selected for conductor 12 and shield 16, a jacket 14 of this type may result in a ribbon conductor assembly 10 with signal-transmission properties that provide an alternative sonic signature (for audio signals).

Shield 16 may be applied by spraying the outer surface of jacket 14 with metallic paint containing particles of copper, silver, gold, aluminum, carbon, graphite, alloys or mixtures thereof, or other suitable electrically-conducting materials in a suitable carrier. Alternatively, shield 16 may be applied by coextruding a suitable electrically-conducting material with the material of jacket 14, depositing a layer of electrically-conducting material on the outer surface of the jacket, or other suitable techniques. Additional types of shield include electrically-conducting foil or braided wrappings surrounding jacket 14.

Conductor 12 is made of a low-resistance electrically-conducting material, such as copper, silver, aluminum, gold, carbon, electrically-conducting plastic, electrically-conducting composite materials, or mixtures or alloys thereof. The purity of the selected material may vary widely depending on the particular application. For example, if conductor 12 is made of copper, the copper is at least approximately 99% pure, more preferably at least 99.9% pure, and most preferably at least 99.99% pure.

The ends of conductor 12 may be plated with a selected metal to further optimize current flow and/or fine-tune sound or audio quality. The composition of conductor 12 may affect the quality of audio and other signals transmitted through the conductor. For example, a conductor 12 made of a particular material may produce fuller and lusher sound than a conductor made of a different material, whereas still another material may produce sound that is perceived to be more detailed and liquid. Thus, the optimum selection of materials for conductor 12, and the purity of those materials, is best determined by a modest amount of experimentation for each particular application.

The ribbon configuration of conductor 12 enhances current flow therethrough, resulting in lower signal distortion that in turn results in enhanced sound and video quality. The surface area of a conductor 12 having a length 1, a cross-sectional width w and a cross-sectional thickness t equals $2(w+t)+2\ wt$; for conductors with $l \gg w \gg t$, the surface area is approximately 2lw. For ribbon conductors having greater width than thickness (i.e., $w>t$), the surface area is greater than the surface area of a conductor with the same length and cross-sectional area but a circular cross-section ($2l(\pi wt)^{1/2}$). A larger surface area relative to the conductor mass corresponds to a lower self-inductance, thus, ribbon conductors have less distortion and better signal transmission properties than conductors having the same surface area and circular cross-sections. The width of conductor 12 can range from less than ¼" (about 0.6 cm) to over 1" (about 2.5 cm). The optimum width:thickness (w:t) ratio depends on the particular application, but is typically at least approximately 10:1 (that is, the width is at least approximately 10 times the thickness, or $w \geqq 10t$).

Jacket 14 clamps conductor 12, reducing resonance effects and thereby improving the frequency response of the conductor (this effect is especially evident at lower frequencies). Jacket 14 contacts conductor 12 only across some or all of its thickness t which is less than its width w (see FIG. 1). Thus, most of the surface area of conductor 12 is contacted by air gaps 18*a*, 18*b*. Unlike cables wherein a dielectric jacket touches the signal-carrying conductor at all points, current flow along conductor 12 is substantially undisturbed by dielectric insulation.

The present invention is further illustrated by the following non-limiting example.

EXAMPLE

A ribbon conductor assembly 10 was constructed with a conductor 12 of 99.99% pure copper and a dielectric jacket 14 of plastic tubing. Jacket 14 was compressed to permit insertion of conductor 12 into the jacket, then released to clamp the conductor securely in place. Shield 16 was applied by spraying the outside of jacket 14 with metallic copper paint. The cable had a w:t ratio of 0.75":0.010" (75:1 or about 1.91:0.025 cm). The cable was determined to have excellent signal-propagation characteristics.

Figure 2:
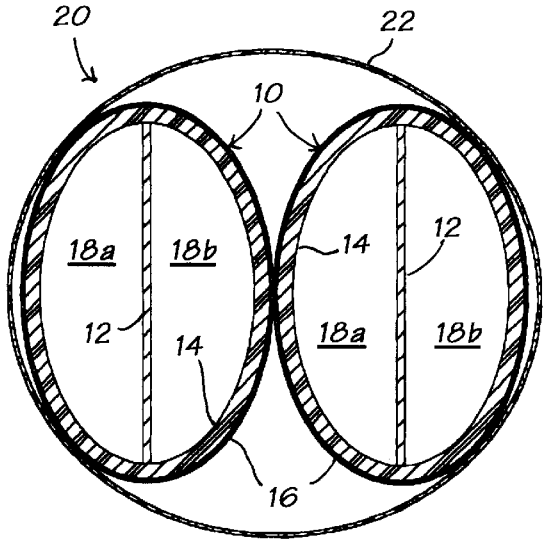
FIG. 2 is a cross-sectional view of a two-conductor electrical cable according to the invention, including two ribbon conductor assemblies as shown in FIG. 1.

Above-described ribbon conductor assembly 10 may be used in electrical cables having one, two, or more conductors. For example, a two-conductor electrical cable 20 (FIG. 2) includes two ribbon conductor assemblies 10 positioned adjacent to each other so that shields 16 are in electrical contact. If shields 16 are in electrical contact with each other, this largely eliminates the problems of variable impedance which might otherwise result from different amounts of insulating material disposed between the shields. Electrical cable 20 may include an electrically-insulating jacket 22 surrounding ribbon cable assemblies 10. Jacket 22 may be made of nylon or other suitable material. While nylon cloth is useful for its light weight and flexibility, jacket 22 may be made of other materials.

A three-conductor electrical cable 30 (FIG. 3) includes two ribbon conductor assemblies 10 (either or both of which may serve as signal carriers) and a ground conductor assembly 32. Ground conductor assembly 32, like ribbon conductor assemblies 10, preferably includes a conductor 12, a dielectric jacket 14, and a shield 16; however, ground conductor assembly 32 may be replaced by some other type of ground conductor if desired. For example, 14-gauge oxygen-free stranded copper wire enclosed by a rubberized Teflon® jacket may be suitable for some applications, Ribbon conductor assemblies 10 and ground conductor assembly 32 are positioned so that their shields 16 are in electrical contact, that is, the shield of each of the three conductor assemblies is in electrical contact with the shield of at least one of the other conductor assemblies. (The thicknesses of shields 16 may vary within the scope of the invention, and may be exaggerated for clarity; the shading of the various components of electrical cable 30 is intended to help the reader distinguish the various components of the cable from each other).

Figure 3:
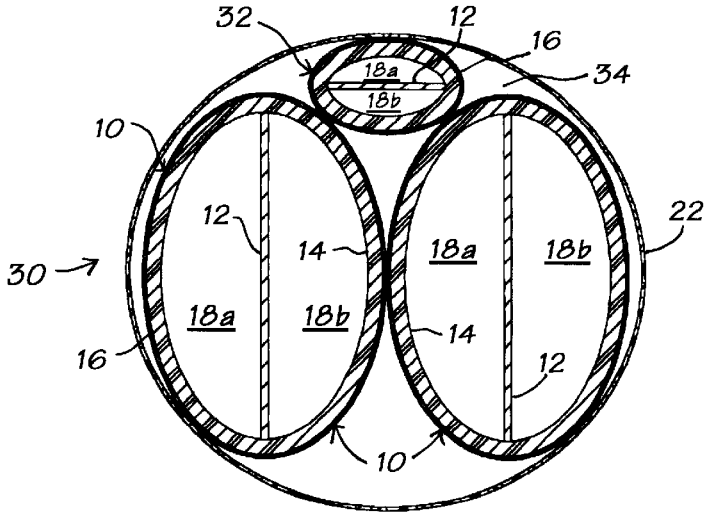
FIG. 3 is a cross-sectional view of a three-conductor electrical cable according to the invention.

Conductors 12 of electrical cable 30 may be aligned approximately parallel to each other; alternatively, any of the conductors may be aligned approximately perpendicular to at least one of the other(s). By way of example, FIG. 3 shows conductor 12 of ground conductor assembly 32 as being approximately perpendicular to conductors 12 of ribbon conductor assemblies 10. Like above-described electrical cable 20, electrical cable 30 may include an electrically-insulating jacket 22. Additional ribbon conductor assemblies 10 (and/or ground conductor assemblies 32) may be provided, as may be needed for various applications.

Figure 5:
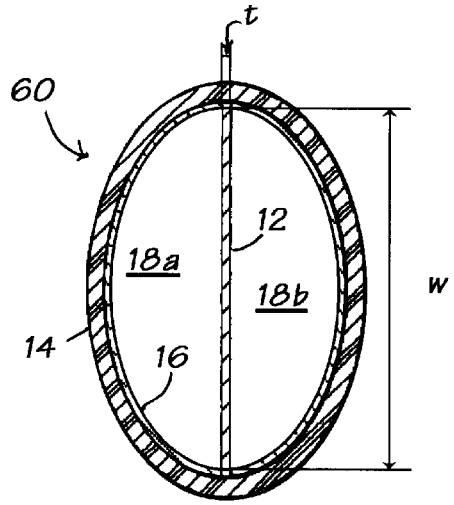
FIGS. 5 and 6 are cross-sectional views of a ribbon conductor assembly and a three-conductor electrical cable, respectively, according to another preferred embodiment of the present invention.

A ribbon conductor assembly 60 according to another preferred embodiment of the present invention is shown in FIG. 5. Like above-described ribbon conductor assembly 10, assembly 60 includes a conductor 12, a dielectric jacket 14, and a thin electrically-conductive shield 16. Here, however, shield 16 is adjacent to the inner surface of jacket 14, and preferably engages substantially all of that surface. Shield 16 may be applied by spraying the inner surface of jacket 14 with metallic paint containing particles of copper, silver, gold, aluminum, carbon, graphite, alloys or mixtures thereof, or other suitable electrically-conducting materials in a suitable carrier. Additional types of shield include electrically-conducting foil or braided wrappings. More preferably, jacket 14 and shield 16 co-extruded by any suitable manufacturing process.

Figure 6:
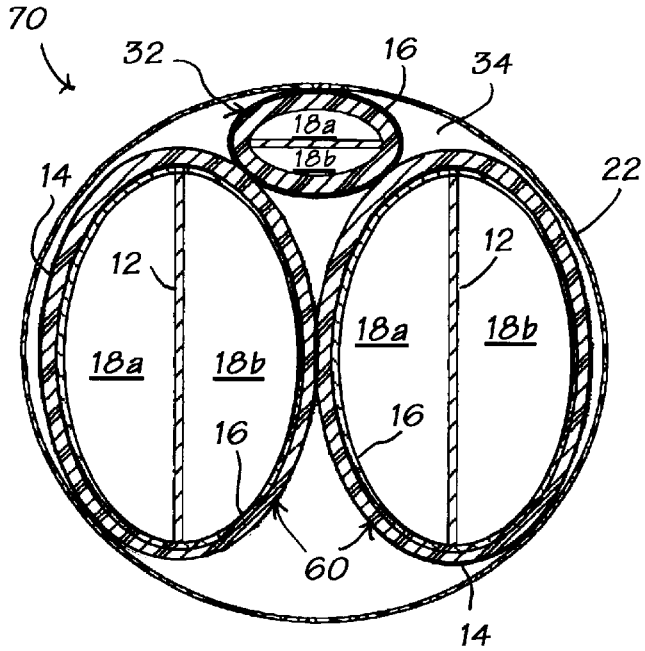

Ribbon conductor assembly 60 may be used in electrical cables having one or more conductors. For example, a three-conductor electrical cable 70 (shown in FIG. 6) has two ribbon conductor assemblies 60 and a ground conductor assembly 32, positioned so that their respective shields 16 are in electrical contact. If desired, ground conductor assembly 32 may be replaced by some other type of ground conductor. Conductors 12 may be aligned approximately parallel to each other; alternatively, any of the conductors may be approximately perpendicular to at least one of the other conductors. For example, conductor 12 of ground conductor assembly 32 is approximately perpendicular to conductors 12 of ribbon conductor assemblies 60 of electrical cable 70. The dimensions of the various components of ribbon conductor assembly 60 and electrical cable 70 may vary widely; thus, the optimum materials and dimensions of these components are best selected using a modest amount of experimentation and observation for each particular application.

Figure 4:
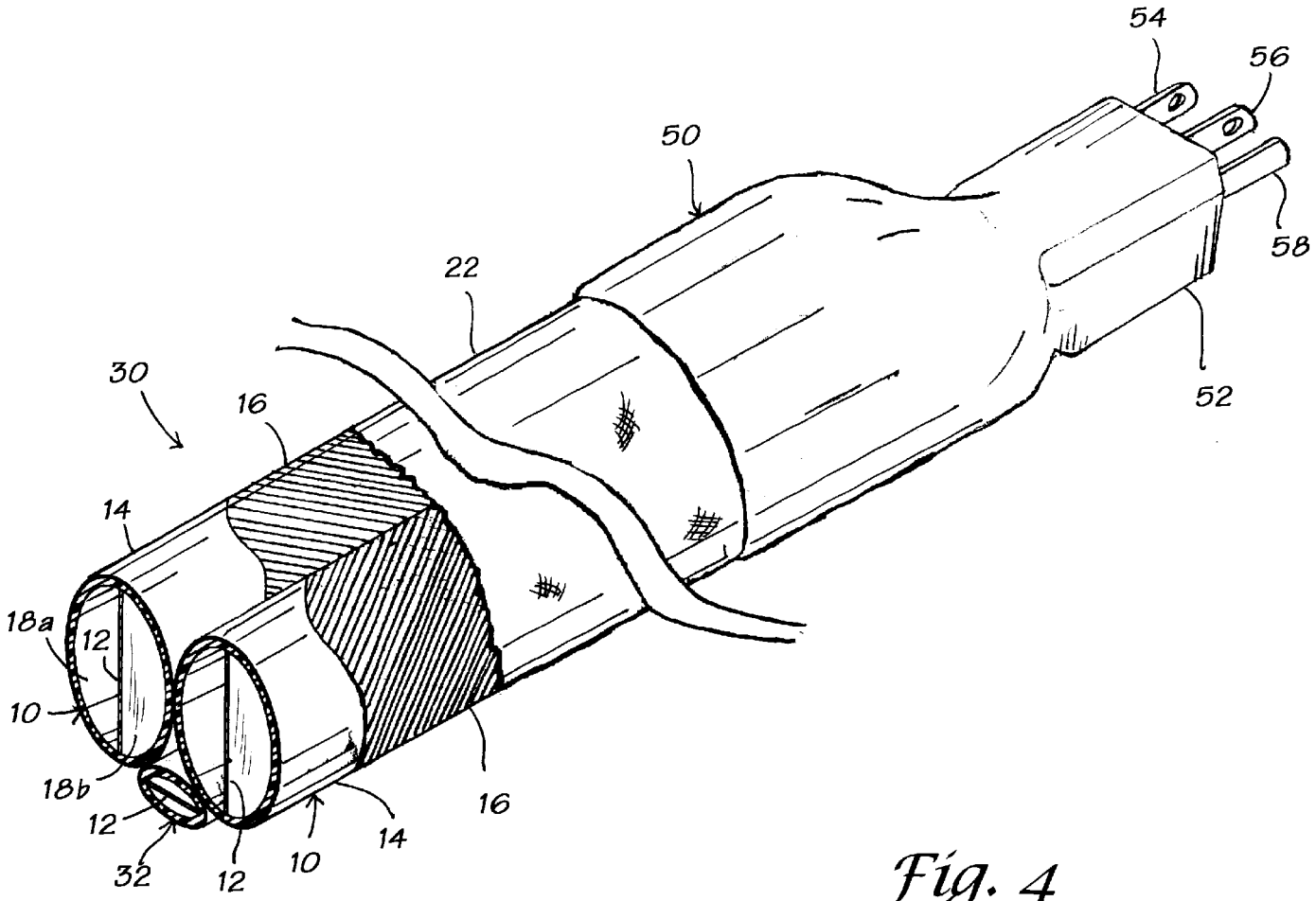
FIG. 4 is a perspective, partially-cut-away view of the electrical cable of FIG. 3, showing one end of the cable connected to a three-prong plug.

The ends of conductors 12 of ribbon conductor assemblies 10, 60 and electrical cables 20, 30, 70 may be connected to any selected male or female terminators, depending on the particular application. Suitable terminators include single-ended interconnects such as RCA plugs, balanced interconnects such as 3-pin XLR connectors, IEC connectors, banana plugs, space lugs, and so forth. For example, an end of electrical cable 30 may be compacted with heat-shrink tubing 50, with conductors 12 connected to a three-prong plug 52. Conductors 12 of ribbon conductor assemblies 10 are connected to pins 54, 56 of plug 52, and conductor 12 of ground conductor assembly 32 is connected to ground prong 58. In FIG. 4, conductors 12 of cables 10 are aligned vertically with respect to plug 52. For flexibility or otherwise, conductors 12 of cables 12 may also be aligned horizontally (or in some other selected direction) with respect to plug 52.

Ribbon conductor assemblies 10, 60 and electrical cables 20, 30, 70 have low impedance and low self-inductance, resonance control via the clamping effect of jackets 14 on conductors 12, and air gaps 18*a*, 18*b* that reduce the deleterious effects of contacting conductors 12 with dielectric materials other than air (or vacuum or other gaseous atmosphere). Thus, an electrical cable according to the invention transmits electrical signals (including signals in the audio and video frequency ranges) with minimal distortion and degradation. The transmission properties of the cables for particular applications can be optimized by selecting the materials used for conductors 12, jackets 14, and shields 16. Cables according to the invention can be used as power cables, interconnect cables, and so forth in audio and video systems (stereo, home theater, electric organs, etc.), computer systems, and other applications where good signal transmission with minimum distortion and minimum degradation is needed.

In a preferred embodiment of the present invention, shield 16 engages substantially all of an inner (or outer) surface of jacket 14. When shield 16 is adjacent a surface of jacket 14 (preferably substantially engaging that surface), the resulting energy fields interact to produce improved signal transmission qualities over those of conventional cables; the optimum placement of the shield is believed to depend on the particular application. For example, when shield 16 is adjacent an inner surface of jacket 14, current flow in ribbon conductor assembly 60 tends to be along the surfaces of ribbon conductor 12 and shield 16. Current flowing in shield 16 produces an electron density containment field ("EDCF") that is believed to "squeeze" and contain the field produced by current flowing in ribbon conductor 12, densifying the field and improving signal transmission when ribbon conductor assembly 60 is used with audio systems.

With respect to the above description of the invention, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing description is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. Thus, it will be apparent to those skilled in the art that many changes and substitutions can be made to the preferred embodiment herein described without departing from the spirit and scope of the present invention as defined by the appended claims.

What is claimed is:

1. An electrical cable, comprising:

a first ribbon conductor assembly including, a first ribbon conductor having an approximately rectangular cross-section transverse to a longitudinal axis of said cable, a first dielectric jacket enclosing said first ribbon conductor, said first jacket having a cross-sectional area greater than a cross-sectional area of said first ribbon conductor transverse to said longitudinal axis, said first jacket positioned to form an air gap substantially surrounding said ribbon conductor, and a first electrically-conductive shield adjacent said first jacket;

a second ribbon conductor assembly including, a second ribbon conductor having an approximately rectangular cross-section transverse to a longitudinal axis of said cable, a second dielectric jacket enclosing said second ribbon conductor, said second jacket having a cross-sectional area greater than a cross-sectional area of said ribbon conductor transverse to said longitudinal axis, said second jacket positioned to form an air gap substantially surrounding said ribbon conductor, and a second electrically-conductive shield adjacent said second jacket, said first and second electrical conductor assemblies being disposed adjacent to one another, each of said first and second ribbon conductors having a width and a thickness, said width being at least approximately ten times said thickness, wherein said first, second, and third ribbon conductors are made of electrically-conducting materials; and a ground conductor assembly including a third ribbon conductor having an approximately rectangular cross-section transverse to a longitudinal axis of said electrical cable, said third ribbon conductor made of an electrically-conducting material;

a third dielectric jacket enclosing said third ribbon conductor, said third jacket having a cross-sectional area greater than a cross-sectional area of said third ribbon conductor transverse to said longitudinal axis, said third jacket positioned to form an air gap on each side of said third ribbon conductor; and a third electrically-conductive shield adjacent said third jacket, said ground conductor assembly being disposed approximately parallel to said longitudinal axis.

2. The electrical cable as recited in claim 1, further comprising an electrically-insulating jacket surrounding said first and second ribbon conductor assemblies.

3. The electrical cable as recited in claim 1, wherein said first and second ribbon conductors include gold, silver, copper, aluminum, electrically-conducting plastic, electrically-conducting composite material, carbon, or combinations thereof.

4. The electrical cable as recited in claim 1, wherein said first and second jackets are made of plastic, rubber, vinyl, glass fiber, carbon fiber, PTFE, ePTFE, PVC, or combinations thereof.

5. The electrical cable as recited in claim 1, wherein said first shield is adjacent an outer surface of said first jacket.

6. The electrical cable as recited in claim 1, wherein said second shield is adjacent an outer surface of said second jacket.

7. The electrical cable as recited in claim 1, wherein said first shield is adjacent an inner surface of said first jacket.

8. The electrical cable as recited in claim 1, wherein said second shield is adjacent an inner surface of said second jacket.

9. The cable as recited in claim 1, further comprising at least one connector electrically connected to said cable.

10. An electrical cable, comprising:

a first ribbon conductor assembly including a first ribbon conductor having an approximately rectangular cross-section transverse to a longitudinal axis of said cable, a first dielectric jacket enclosing said first ribbon conductor, said first jacket having a cross-sectional area greater than a cross-sectional area of said first ribbon conductor transverse to said longitudinal axis, said first jacket positioned to form an air gap on each side of said ribbon conductor, and a first electrically-conductive shield adjacent said first jacket;

a second ribbon conductor assembly including a second ribbon conductor having an approximately rectangular cross-section transverse to a longitudinal axis of said cable, a second dielectric jacket enclosing said second ribbon conductor, said second jacket having a cross-sectional area greater than a cross-sectional area of said ribbon conductor transverse to said longitudinal axis, said second jacket positioned to form an air gap on each side of said ribbon conductor, and a second electrically-conductive shield adjacent said second jacket, said first and second electrical conductor assemblies being disposed adjacent to one another, each of said first and second ribbon conductors having a width and a thickness, said width being at least approximately ten times said thickness; and a ground conductor assembly including a third ribbon conductor having an approximately rectangular cross-section transverse to a longitudinal axis of said electrical cable, a third dielectric jacket enclosing said third ribbon conductor, said third jacket having a cross-sectional area greater than a cross-sectional area of said third ribbon conductor transverse to said longitudinal axis, said third jacket positioned to form an air gap on each side of said third ribbon conductor, and a third electrically-conductive shield adjacent said third jacket, said ground conductor assembly being disposed approximately parallel to said longitudinal axis.

11. The electrical cable as recited in claim 10, further comprising an electrically-insulating jacket surrounding said first and second ribbon conductor assemblies.

12. The electrical cable as recited in claim 10, wherein at least one of said first, second, and third ribbon conductors includes gold, silver, copper, aluminum, electrically-conducting plastic, electrically-conducting composite material, carbon, or combination thereof.

13. The electrical cable as recited in claim 10, wherein at least one of said first, second, and third jackets is made of plastic, rubber, vinyl, glass fiber, carbon fiber, PTFE, ePTFE, PVC, or combination thereof.

14. The electrical cable as recited in claim 10, wherein at least one of said first, second, and third shields is adjacent an outer surface of said first, second, and third jacket, respectively.

15. The electrical cable as recited in claim 10, wherein at least one of said first, second, and third shields is adjacent an inner surface of said first, second, and third jacket, respectively.

16. The electrical cable as recited in claim 10, further comprising at least one connector electrically connected to said cable.

* * * * *